US010975613B2

(12) United States Patent
Taylor et al.

(10) Patent No.: US 10,975,613 B2
(45) Date of Patent: Apr. 13, 2021

(54) GARAGE DOOR WITH OPERABLE ROTATING AND RETRACTABLE PANELS

(71) Applicant: New Heaven and Earth Designs LLC, Miami, FL (US)

(72) Inventors: Stephanie Taylor, Miami, FL (US); Johnathan Taylor, Miami, FL (US); Larry Gene Taylor, Boca Raton, FL (US)

(73) Assignee: NEW HEAVEN AND EARTH DESIGNS. LLC, Tamarac, FL (US)

( * ) Notice: Subject to any disclaimer, the term of this patent is extended or adjusted under 35 U.S.C. 154(b) by 0 days.

(21) Appl. No.: 16/709,097

(22) Filed: Dec. 10, 2019

(65) Prior Publication Data

US 2020/0109596 A1 Apr. 9, 2020

Related U.S. Application Data

(63) Continuation-in-part of application No. 15/198,870, filed on Jun. 30, 2016, now abandoned.

(51) Int. Cl.

| | |
|---|---|
| ***E06B 3/70*** | (2006.01) |
| ***E05F 15/77*** | (2015.01) |
| ***G08B 21/14*** | (2006.01) |

(52) U.S. Cl.

CPC ..... *E06B 3/70* (2013.01); *E05F 15/77* (2015.01); *G08B 21/14* (2013.01); *E05Y 2900/106* (2013.01); *E06B 2003/7044* (2013.01)

(58) Field of Classification Search

CPC .. E05F 15/67; E05F 15/72; E06B 2003/7057; E06B 7/09; E06B 3/70; E06B 2003/7044

See application file for complete search history.

(56) References Cited

U.S. PATENT DOCUMENTS

| | | | | | |
|---|---|---|---|---|---|
| 817,983 | A * | 4/1906 | Noblett | ..... | 160/207 |
| 1,889,638 | A * | 11/1932 | Cooper | ..... | E05D 15/14 160/190 |
| 1,989,658 | A * | 1/1935 | McCloud | ..... | E06B 3/485 160/116 |
| 2,585,627 | A * | 2/1952 | Cornell | ..... | E06B 9/17 160/180 |
| 3,927,709 | A * | 12/1975 | Anderson | ..... | E05D 15/24 160/37 |
| 4,141,403 | A * | 2/1979 | Church | ..... | E05D 15/24 160/201 |
| 4,378,043 | A * | 3/1983 | Sorenson | ..... | E06B 7/03 160/201 |
| 4,535,237 | A * | 8/1985 | Takahashi | ..... | G21K 4/00 250/484.4 |
| 4,537,237 | A * | 8/1985 | Sepulveda | ..... | E05D 15/24 160/116 |
| 4,770,087 | A * | 9/1988 | Danley | ..... | E06B 3/485 160/92 |

(Continued)

*Primary Examiner* — Gregory J Strimbu

(74) *Attorney, Agent, or Firm* — Trueba & Suarez, PLLC; Roberto M. Suarez

(57) ABSTRACT

A garage door apparatus includes at least one panel integral to a garage door structure. The panel is rotatable with respect to the surrounding garage door structure, such that, as the panel is rotated, the panel substantially uncovers an opening in the garage door structure. The panel is also selectively retractable into the surrounding garage door structure such that the opening is unobstructed.

7 Claims, 8 Drawing Sheets

(56) References Cited

U.S. PATENT DOCUMENTS 5,163,494 A * 11/1992 MacNeil ..... E06B 3/928 160/188
6,092,580 A * 7/2000 Lucas ..... E06B 3/485 160/113
6,386,969 B1 * 5/2002 O'Brien ..... E06B 7/02 454/195
6,715,527 B2 * 4/2004 Ardoin ..... E06B 7/086 160/104
7,152,371 B2 * 12/2006 Vaccari ..... E06B 7/32 49/169
7,169,038 B1 * 1/2007 Vignau ..... E06B 7/02 454/195
7,370,684 B2 * 5/2008 Padan ..... E06B 3/927 160/169
7,484,286 B2 * 2/2009 Fowler ..... E06B 3/7001 160/104
8,371,356 B2 * 2/2013 Manser ..... E06B 9/17 160/201
9,163,451 B1 * 10/2015 Curry ..... E05D 15/08
2006/0038468 A1 * 2/2006 Morgan ..... A47B 96/16 312/245
2007/0234643 A1 * 10/2007 Siegal ..... E05D 13/1284 49/360
2008/0210388 A1 * 9/2008 Padan ..... E06B 9/302 160/201
2011/0259529 A1 * 10/2011 Clear ..... A47H 23/06 160/7
2014/0277749 A1 * 9/2014 Choo ..... E06B 9/72 700/275
2015/0204135 A1 * 7/2015 Faccone ..... E05F 15/00 49/146
2015/0225998 A1 * 8/2015 Muto ..... E06B 9/52 49/465
2019/0257138 A1 * 8/2019 Vitello ..... E06B 9/54
2019/0277077 A1 * 9/2019 Ben-Arie ..... E05F 11/40

* cited by examiner

GARAGE DOOR WITH OPERABLE ROTATING AND RETRACTABLE PANELS

CROSS-REFERENCE TO RELATED APPLICATIONS

This application is a continuation in part of, incorporates by reference, and claims priority to, U.S. non-provisional patent application Ser. No. 15/198,870, filed on Jun. 30, 2016, co-pending at time of filing of this application, now currently abandoned.

FIELD OF THE INVENTION

The invention disclosed broadly relates to the field of building structures, and more particularly relates to the field of apparatus, systems, and methods of providing selectively open areas in garage doors through implementation of rotating and retracting panels.

BACKGROUND OF THE INVENTION

It is a common experience for a homeowner to enjoy the space and convenience of their garage. In good weather, this covered space may be enjoyed with the garage door open, effectively creating a covered patio, game area, or just more square footage within which to enjoy life. It is not always desirable, however to keep the garage door open. Whether for safety reasons, or just because the weather is bad, the enjoyment of the garage is often curtailed due to having to keep the garage door closed. Heat buildup, lack of ventilation, or even lack of visibility to the outside are just some of the drawbacks of a traditional garage door.

Prior attempts in the art have been made to address some of these issues. For example, the addition of a window into the door allows for light and visibility, but does not help with ventilation. Louvered slats allow for airflow, but still obstruct visibility. Hinged panels, or doors-within-the-door, are plainly impractical.

Furthermore, prior attempts in the art to address these problems and shortcomings, merely provide mechanical solutions. For example, louvered slats may be convenient forms of accounting for ventilation, but will still need to be manually opened and closed.

Therefore, there is a need for an apparatus, system, and method for providing a garage door with operable rotating and retractable panels, which aims to overcome the above-stated shortcomings of the known art.

SUMMARY

In this specification and in the appended claims and drawings, words and phrases have the meanings commonly attributed to them in the relevant art except as otherwise specified herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In view of the foregoing, a preferred embodiment of the present invention is directed to a garage door apparatus with a one or more panel integral to the garage door structure. This one or more panel is rotably operable with respect to the surrounding garage door structure, such that as the panel is rotated it presents an opening in the garage door structure. This rotably operable panel is also selectively retractable into the garage door structure such that a substantially unobstructed opening may be left in the garage door structure.

Further embodiments of the present invention include electronic actuation means operably coupled to the rotable and retractable panels. In this way, the one or more panels may be rotated and/or retracted automatically by a user or as directed by monitoring software.

Embodiments of the invention further contemplate logic and sensor means operably coupled to the apparatus so that a user may operate the apparatus through a specially programmed wireless communication device enabled with a user interface and communicatively coupled via a communications network. Alternatively, the user may choose to program the apparatus to react automatically based upon environmental inputs such as the detection of unsafe levels of Carbon Monoxide, excessive temperatures, or rain.

BRIEF DESCRIPTION OF THE SEVERAL VIEWS OF THE DRAWINGS

To describe the foregoing and other exemplary purposes, aspects, and advantages, we use the following detailed description of an exemplary embodiment of the disclosure with reference to the drawings, in which.

Figure 1:
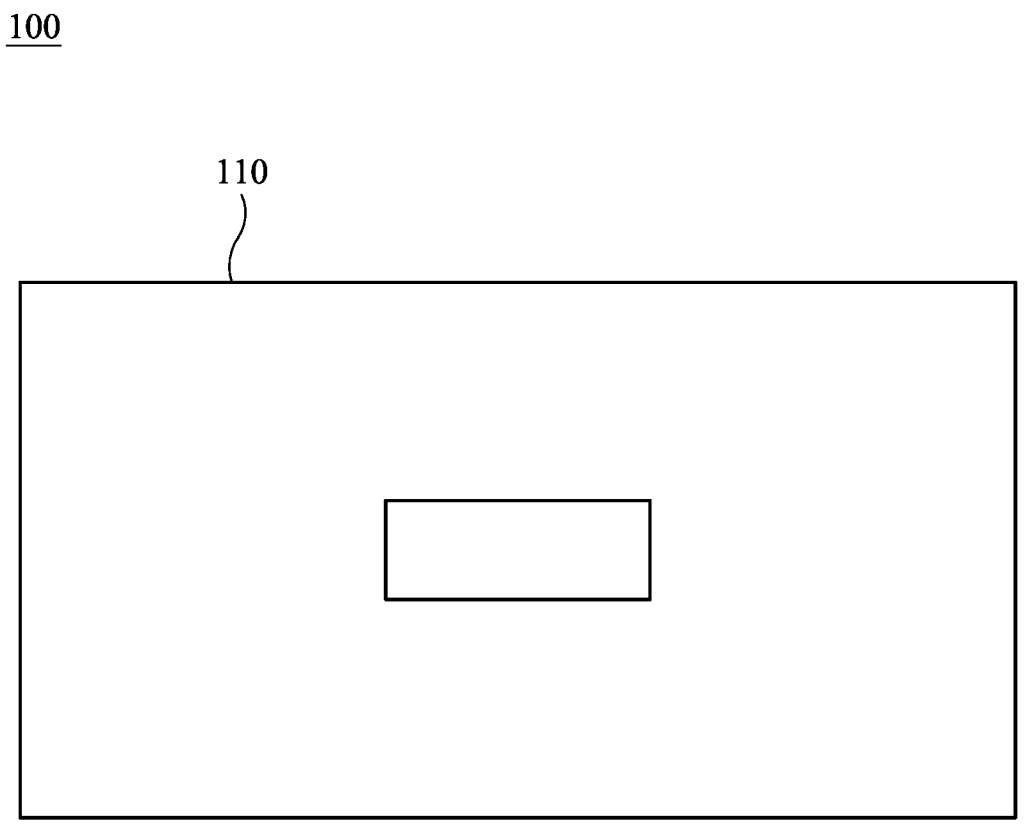
FIG. 1 is a front view representation of a garage door apparatus according to one embodiment of the present disclosure.
Figure 2A:
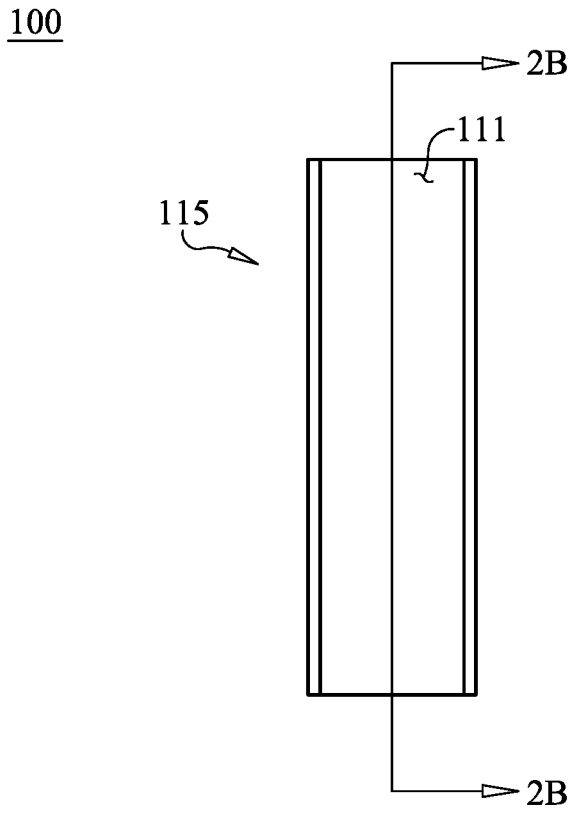
FIG. 2A is a side view of the apparatus of FIG. 1.
Figure 2B:
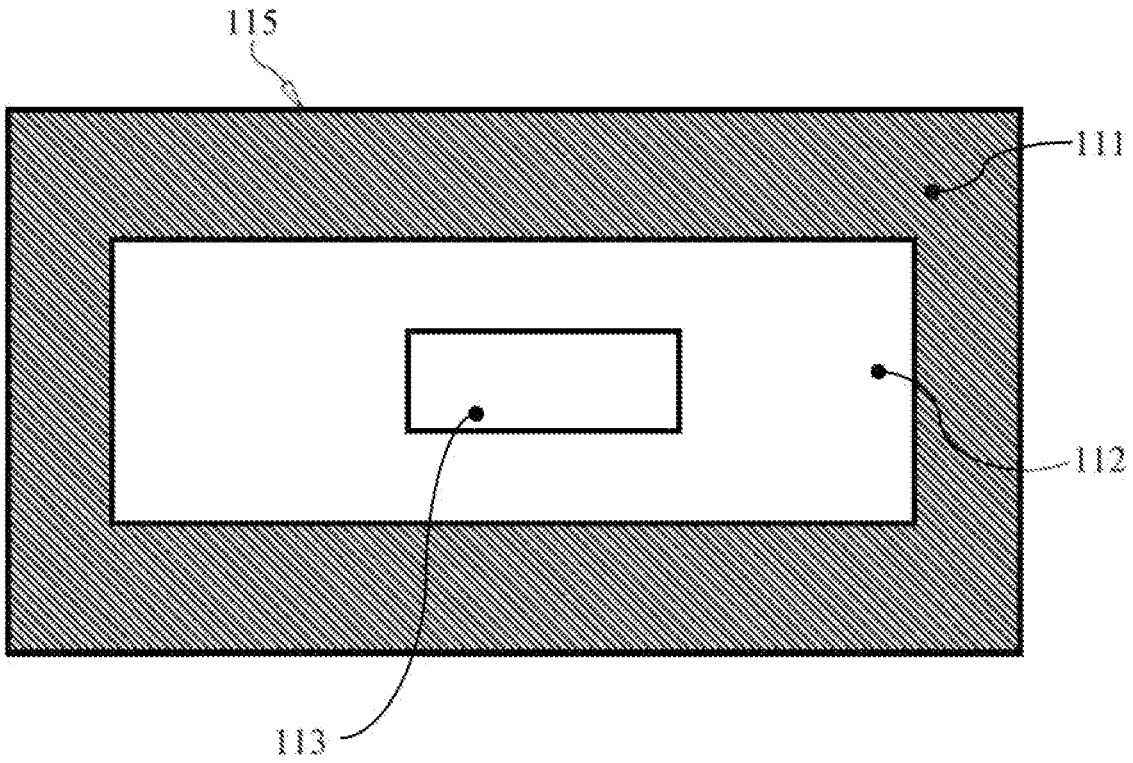
FIG. 2B is a cross-sectional view of the apparatus of FIG. 2A.

While the invention as claimed can be modified into alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the scope of the present disclosure.

DETAILED DESCRIPTION

In the Summary above, in the Description below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, structures, steps, etc. are optionally present. For example, an article "comprising" (or "which comprises") components A, B, and C can consist of (i.e., contain only) components A, B, and C, or can contain not only components A, B, and C, but also one or more other components or structures.

The term "at least" followed by a number is used herein to denote the start of a range beginning with that number (which may be a range having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40% means 40% or less than 40%. When, in this specification, a range is given as "(a first number) to (a second number)" or "(a first number)-(a second number)," this means a range whose lower limit is the first number and whose upper limit is the second number. For example, 25 to 100 mm means a range whose lower limit is 25 mm, and whose upper limit is 100 mm.

Any element in a claim that does not explicitly state "means for" performing a specified function, or "step for" performing a specific function, is not to be interpreted as a "means" or "step" clause as specified in 35 U.S.C. § 112, ¶6. In particular, the use of "step of" in the claims herein is not intended to invoke the provisions of 35 U.S.C. § 112, ¶6.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein. Specifically, component names, types, and values, as depicted in the exemplary schematic diagrams, are not intended to limit the scope of the present invention and are presented only as possible embodiments.

While the specification will conclude with claims defining the features of embodiments of the invention that are regarded as novel, it is believed that the invention will be better understood from a consideration of the following description in conjunction with the figures, in which like reference numerals are carried forward.

Before describing, in detail, embodiments that are in accordance with the present disclosure, it should be observed that some of the embodiments may reside primarily in combinations of method steps and system components related to systems and methods for placing computation inside a communication network. Accordingly, the system components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Thus, it will be appreciated that for simplicity and clarity of illustration, common and well-understood elements that are useful or necessary in a commercially feasible computing or communications embodiment may not be depicted in order to facilitate a less obstructed view of these various embodiments.

Garage Door System 100

Referring now in specific detail to the drawings, and to FIG. 1 in particular, there is shown a garage door system 100. In this preferred embodiment of the invention, multiple components are combined, thereby providing a system for providing a selectably rotable and retractable panel 150 within a garage door 110 whereby the system can provide for a completely open, partially open, or completely closed portion of the garage door 110. The garage door system 100 comprises a garage door 110 and a motorized panel apparatus 120.

The garage door 110 is an improvement over what is known in the art. Garage door 110 is comprised of one or more door panel 115. In some versions, the garage door 110 is just one large door panel 115. In other versions, the garage door 110 is made up of multiples of door panel 115, where the multiple door panels 115 are joined together with fixed mechanical attachments, or with articular attachments, such as hinges. In other embodiments, garage door 110 may be made up of at least one door panel 115 and at least one standard garage door panel as is known in the art. The door panel 115 is preferably manufactured as a composite, or sandwich, construction with a front skin bonded to a core bonded to a back skin. In this way the door panel 115 has a solid portion 111 with the front skin-core-back skin intact, a hollow portion 112 where the front skin and back skin are intact but with no core, and an opening portion 113 through the entire door panel 115 with no front skin, core, or back skin.

Figure 5:
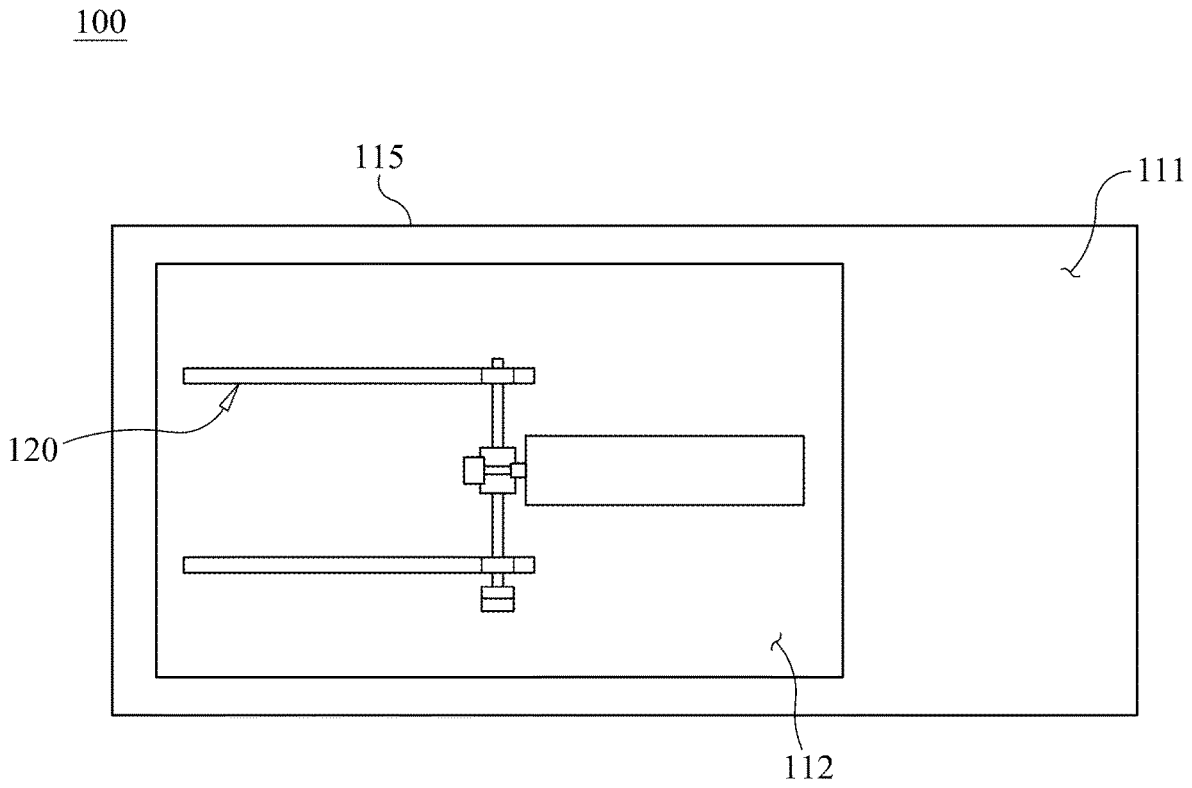
FIG. 5 is a front view of a garage door system, with the front skin removed to show the interior components and the motorized panel apparatus mounted within the garage door panel.
Figure 6:
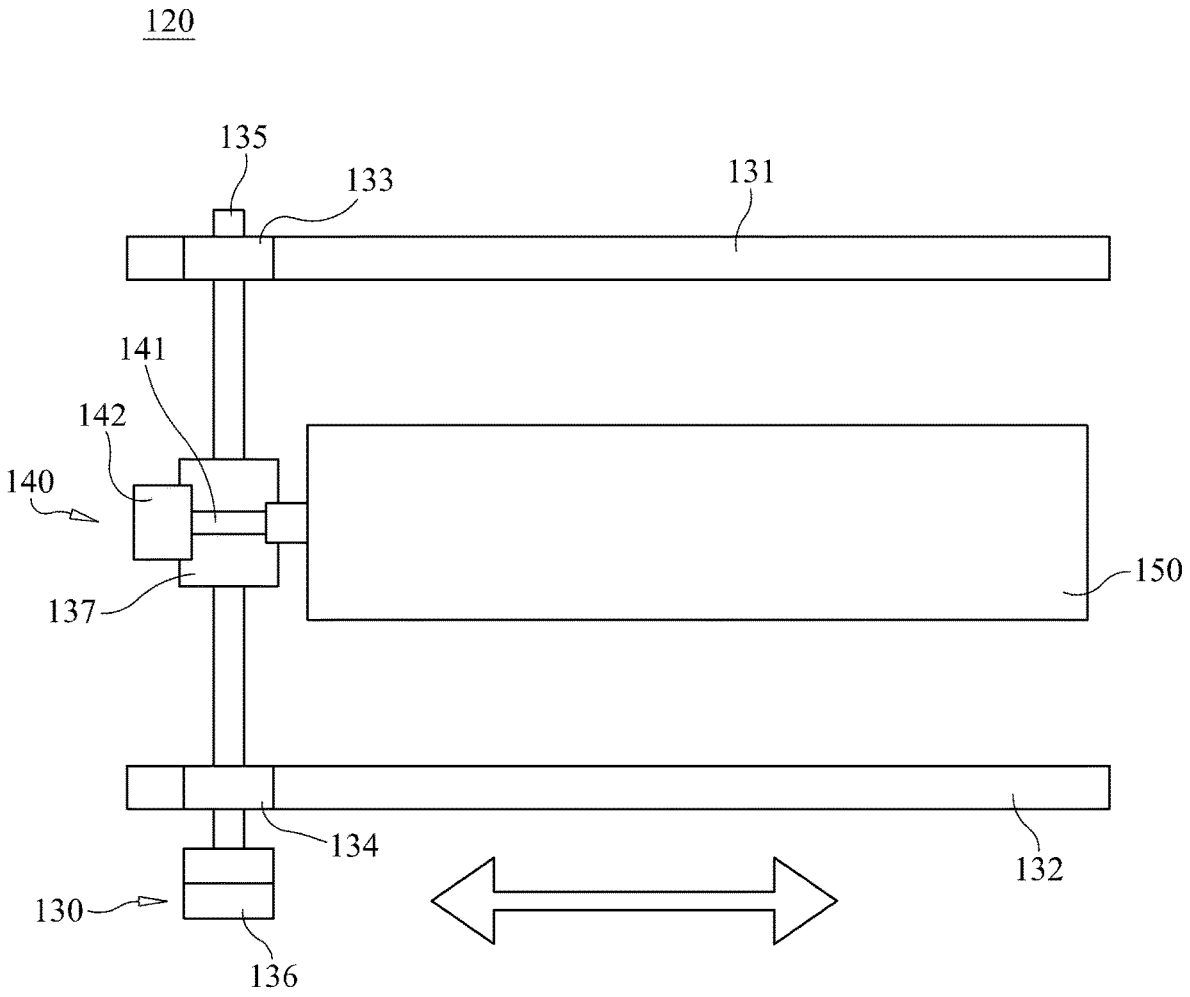
FIG. 6 is a front view of the motorized panel apparatus.
Figure 7:
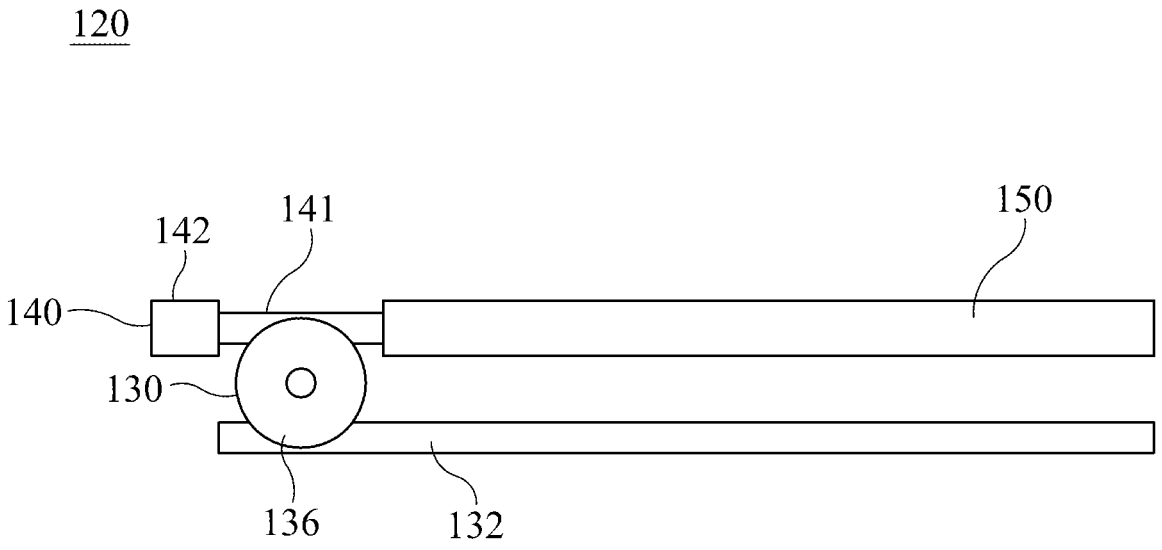
FIG. 7 is a bottom view of the motorized panel apparatus of FIG. 6.

The motorized panel apparatus 120 (see FIGS. 6 and 7) is comprised of a retracting mechanism 130, a rotating mechanism 140, and a panel 150. The motorized panel apparatus 120 is installed within the hollow portion 112 of the door panel 115 such that the retracting mechanism 130 and the rotating mechanism 140 are housed within the hollow portion 112 (see FIG. 5). The panel 150, being configured to translate by action of the retracting mechanism 130, is installed such that in an open state the panel 150 is substantially within the hollow portion 112, and in a closed state the panel 150 is substantially within the opening portion 113.

The retracting mechanism 130 comprises an upper rack and pinion pair, a lower rack and pinion pair, a retracting shaft 135, a panel mount 137, and a retracting motor 136. The upper rack 131 is fixedly attached to the door panel 115 and disposed substantially within the hollow portion 112 of the door panel 115 and above the opening portion 113. The lower rack 132 is fixedly attached to the door panel 115 parallel to and in spaced relation to the upper rack 131 and disposed substantially within the hollow portion 112 of the garage door 110 and below the opening 113. The upper and lower racks are attached to one of the front skin or back skin, within the hollow portion 112 of the door panel 115. The attachment type may be a mechanical fastener, such as a screw, rivet, or the like, or an adhesive, such as glue or epoxy. The length of the upper rack 131 and lower rack 132 is configured to be at least as long as the amount of travel required to retract the panel 150 from the closed state to the open state.

The upper pinion 133 is operatively in communication with the upper rack 131 and the lower pinion 134 is operatively in communication with the lower rack 132. A retracting shaft 135 axially connects the upper pinion 133 and the lower pinion 134 such that a rotation of the retraction shaft 135 causes a corresponding rotation of the upper pinion 133 and the lower pinion 134. Rotation of the upper pinion 133 and lower pinion 134, in engagement with the upper rack 131 and lower rack 132, respectively, results in a translation of the pinions and shaft in a direction along the racks.

A retracting motor 136 with a retracting motor output shaft is operatively communicative with the retracting shaft 135 such that a rotation of the retracting motor output shaft causes a rotation of the retracting shaft 135. The retracting motor output shaft may be directly and axially attached to the retracting shaft 135. In this way a rotation of the retracting motor output shaft results in a 1:1 rotation of the retracting shaft 135. In embodiments, the retracting motor output shaft may be connected to the retracting shaft 135 via a gearbox in order to achieve a gear differential or to drive the retracting shaft 135 in other than an axial alignment.

A panel mount 137 is axially disposed on the retraction shaft 135 in a fixed spaced relation between the upper pinion 133 and the lower pinion 134 such that the retraction shaft 135 is free to rotate. In embodiments, the panel mount 137 is a bracket with a bushing, or equivalent structure, configured to receive the retraction shaft 135 such that the retraction shaft 135 is free to rotate but not translate relative to the panel mount 137. The panel mount 137 is further configured to receive the rotation shaft 141 and the rotation motor 136, as discussed below.

The rotating mechanism 140 comprises a rotation motor 142 attached to a rotation shaft 141. The rotation shaft 141 is rotatably attached to the panel mount 137 and disposed substantially perpendicular to the retraction shaft 135 such that a translation of the retraction shaft 135 causes a corresponding translation of the rotation shaft 141. The rotation motor 142 with a rotation motor output shaft is operatively communicative with the rotation shaft 141 such that a rotation of the rotation motor output shaft causes a rotation of the rotation shaft 141. As with the retraction motor 136, the rotation motor output shaft may directly drive the rotation shaft 141 or, alternatively, the rotation motor output shaft may be coupled to a gearbox which, in turn, is coupled to the rotation shaft 141.

The panel 150 is connected to the rotation shaft 141 such that the rotation of the rotation shaft 141 causes a corresponding rotation of the panel 150. The dimensions of the panel 150 are chosen by the ordinary artisan to correspond substantially with the dimensions of the garage door panel 115, the hollow portion 112, and the opening portion 113. For example, in a preferred embodiment, the panel 150 is dimensioned such that, in the retracted position (the open state), the panel 150 is contained substantially within the hollow portion 112 of the door panel 115, and in the translated position (the closed state), the panel 150 substantially fills (closes) the opening portion of the door panel 115. It is contemplated that in some embodiments, the panel 150 may be taller than the thickness of the door panel 115. In this embodiment, it would only be necessary to have the panel 150 rotated to be substantially parallel to the door panel 115 in order to retract into the hollow portion 112 in the open state. It is contemplated to be within the scope of the invention for the panel 150 to be opaque, transparent, or semi-opaque, or semi-transparent.

The garage door system 100, as disclosed in the embodiment above, is operable to translate the panel 150 between a position substantially within the hollow portion 112 of the door panel 115 and a position substantially within the opening 113 of the door panel 115, and further operable to rotate the panel 150 between a position substantially parallel to the door panel 115 and a position substantially perpendicular to the door panel 115.

The preceding embodiment is disclosed to illustrate the components of the system 100 and how they interact to provide the desired solution. This embodiment is in no way intended to limit the scope of the invention. It is within the scope of the present invention, for example, that a single retracting mechanism 130 may be configured with multiple panel mounts 137 in order to accommodate multiple panels 150 and corresponding rotating mechanisms 140. In this way, an opening in a garage door panel 115 may be closed by multiple panels 150, and not just one.

Other embodiments of the invention may include additional structures or components to aid with the installation and/or stability of the system 100. For example, an embodiment of the invention may further comprise a second set of pinions on the racks, connected by a shaft communicative with the panel 150 at the free end—the end of the panel 150 distal to the end connected to the rotating shaft 141. Another embodiment of the present invention may further comprise seals, baffles, brush seals, wiper seals, or equivalent structures to at least partially block off the hollow portion 112 from the opening portion 113. Yet additional structures may be incorporated to aid in alignment of the racks and pinions, tracking of the panel, or biasing and stabilizing of the mechanism within the garage door panel.

For compactness of disclosure, design choices that would be made by a person of ordinary skill in the art without undue experimentation have been omitted here. For example, an ordinarily skilled artisan would size the various components to fit and operate within the dimensions of the garage door panel 115. Similarly, an ordinarily skilled artisan would know that the motors would need to receive power in order to operate and would, accordingly supply power based upon the requirements of the motor chosen. Likewise, with the motors, an ordinarily skilled artisan would be able to choose between various motor types such as DC, brushless, servos, and the like. Likewise, simple mechanical attachment methods are not discussed as these would be chosen by the ordinarily skilled artisan without undue experimentation.

Further embodiments of the present invention include electronic actuation means operably coupled to the rotatable and retractable panels 150. In this way, the one or more panels 150 may be rotated and/or retracted automatically by a user or as directed by monitoring software. The panels 150 could be automatically opened with an electrical switch, remote control, mobile device, or manually opened. While the embodiments shown in the various figures illustrate panels 150 in a horizontal configuration, it is contemplated to be within the scope and spirit of the present disclosure that the panels 150 may be configured and operable in either a horizontal or vertical direction.

Electronics and Control Module

Figure 4:
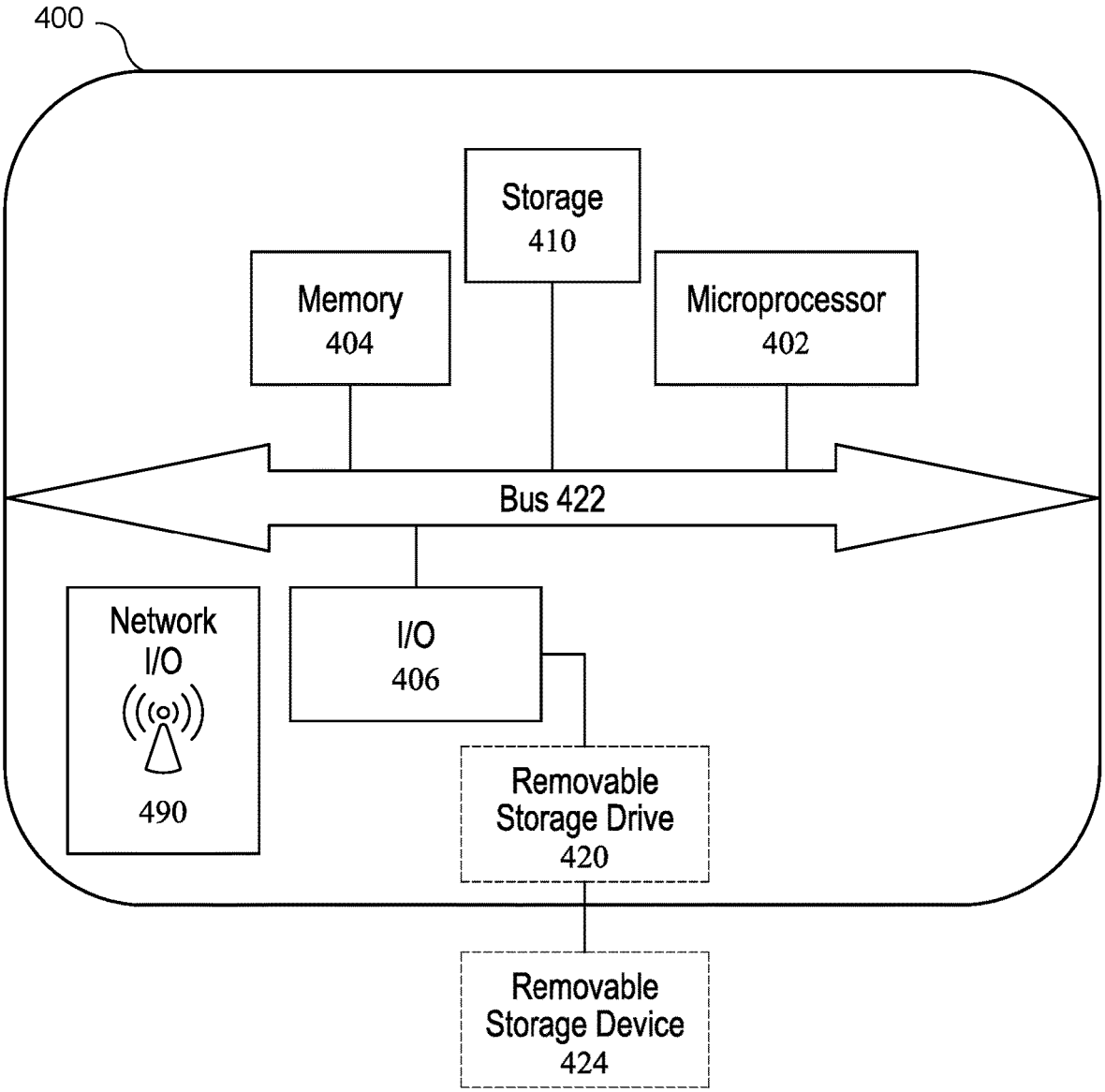
FIG. 4 is a simplified block diagram of an electronics control module of the apparatus, according to an embodiment of the present disclosure.

Embodiments of the invention further contemplate logic and sensor means operably coupled to the apparatus so that a user may operate the apparatus through a specially programmed wireless communication device (such as mobile phone 195) enabled with a user interface and communicatively coupled via a communications network (190). Alternatively, the user may choose to program the apparatus to react automatically based upon environmental inputs such as the detection of unsafe levels of carbon monoxide, excessive temperatures, or rain. Referring now to FIG. 4, Embodiments of the garage door system 100 may include an electronics and control module (ECM) 400. This ECM 400 is fixedly attached to the door panel 115 and disposed integral to the hollow portion 112 of the door panel 115. The electronics and control module 400 is electrically connected to each of the retraction motor 136 and the rotation motor 142. Electrical power is delivered to the ECM 400 through either a direct hard-wired electrical connection, an integrated battery pack, or both.

The ECM 400 may also be configured with sensors and logic circuits in order to perform various additional functions. For example, embodiments of the invention may be configured with a one or more carbon monoxide sensor (not shown). This sensor would be electrically coupled with the ECM 400 such that, the carbon monoxide sensor and a logic module are configured to activate the rotation motor 142 to rotate the panel 150 to the position substantially perpendicular to the door panel 115 when the carbon monoxide sensor detects an amount of carbon monoxide larger than a preset high level, thereby ventilating the garage. When the ECM 400 detects that the carbon monoxide sensors detects a preset safe level of carbon monoxide after having detected an amount of carbon dioxide larger that a preset high level reduced to a safe level, the ECM 400 may, optionally, re-close the one or more panel 150. Other such sensors may include, by way of illustration and not limitation, temperature sensors and rain sensors.

Figure 3:
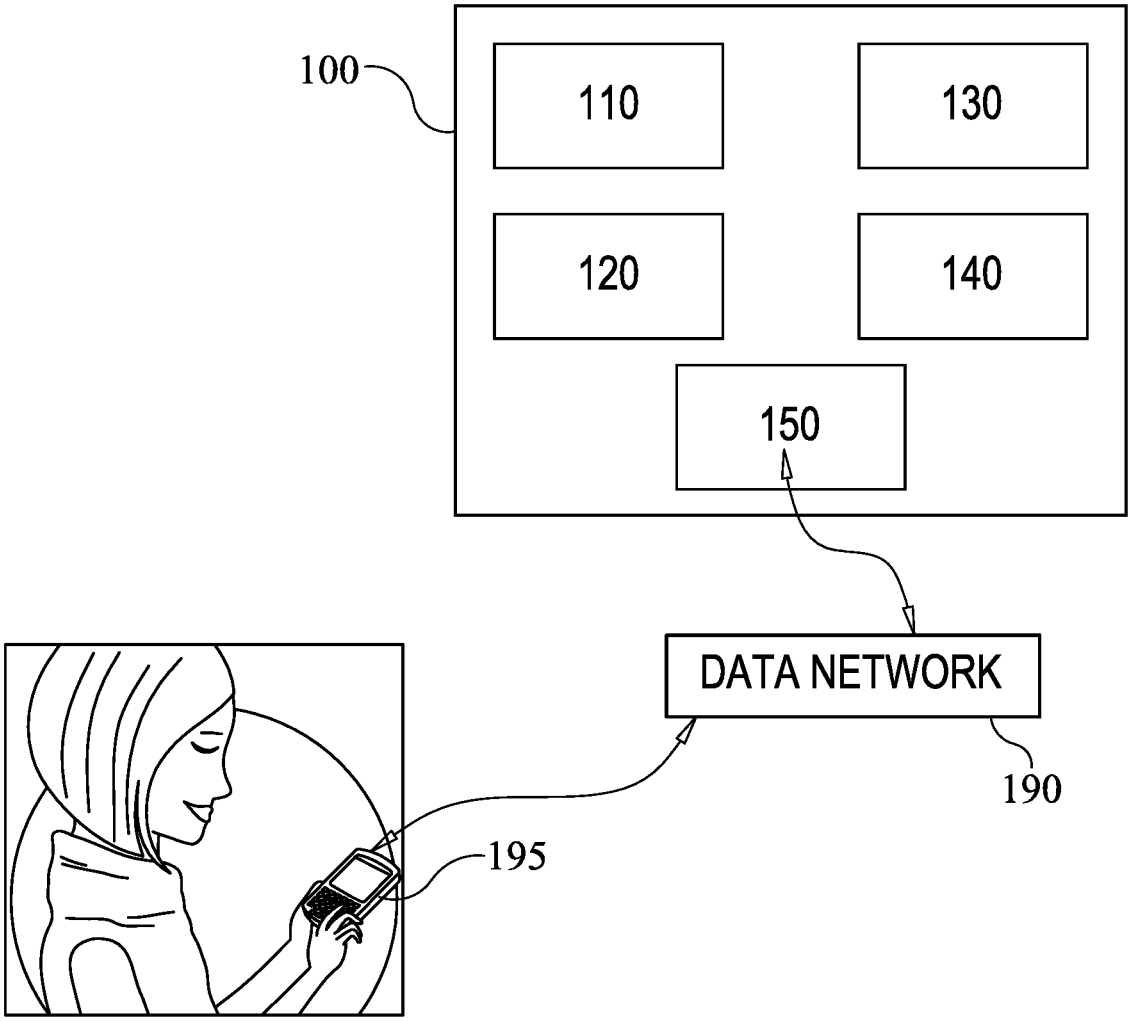
FIG. 3 is simplified representation of system showing a user communicating with the apparatus via a data network, according to an embodiment of the present invention.

Still further embodiments of the garage door system 100 may also comprise dedicated hardware and software for enabling wireless communication over a network, as illustrated in FIG. 3. In such an embodiment, the ECM 400 may further comprise dedicated hardware and software so that the garage door system 100 appears as a node on a data network 190. Another node on the data network 190, such as a specially programmed computing device 195, may then communicate with the apparatus via the ECM 400. In this way, a person utilizing the specially programmed computing device may, for example, monitor the position of the panels 150 (open, closed, partially opened, etc.). Additional information may be communicated by the ECM 400, such as data from the one or more sensors.

By way of illustration, and not limitation, an embodiment of the apparatus may be configured as a Bluetooth-enabled device. A homeowner may download and install a mobile application onto a Bluetooth-enabled mobile computing device 195, thereby converting the device 195 into a specially programmed computing device. Through a user interface provided by the mobile application, the user may view the status of the apparatus, open or close the panels, view alerts, or set operation parameters for the apparatus.

Further embodiments of the apparatus are configured to place the apparatus as a node on a local area network, or as a node accessible via a wide area network, or even the Internet.

The ECM 400 components can be realized each as one or more computing devices, executing a variety of scripts, databases, processes, and related components. Components of the ECM 400 shown in FIG. 4 are for illustrative purposes only, to facilitate an understanding of the services and features of ECM 400. One with knowledge in the art will appreciate that the components may represent all hardware components, all software components, or a combination of hardware and software components.

The Data Network 190 includes a single or a plurality of connected data networks, including private and public networks, including the Internet, and such networks may or may not be comprised of circuits or components across multiple business entities, service providers, physical and protocol layer data networking methods and technologies, and located across diverse physical locations.

In one embodiment, referring now to FIG. 4, the ECM 400 includes a physical computing device configured with network connectivity, such as Ethernet IEEE 802.3, Wireless such as IEEE 802.11, Bluetooth, ZigBee, or Cellular Wireless such as GSM. Such dedicated computing device further includes a microprocessor device 402 which communicates with an input/output subsystem 406, memory 404, storage 410 and network interface 490. The microprocessor device 402 is operably coupled with a communication infrastructure herein represented as bus 422. Bus 422 is a simplified representation of the communication infrastructure required in a device of this type.

The microprocessor device 402 may be a general or special purpose microprocessor operating under control of computer program instructions executed from memory 404 on program data. The microprocessor 402 may include a number of special purpose sub-processors, each sub-processor for executing particular portions of the computer program instructions. Each sub-processor may be a separate circuit able to operate substantially in parallel with the other sub-processors. Some or all of the sub-processors may be implemented as computer program processes (software) tangibly stored in a memory 404 that perform their respective functions when executed. These may share an instruction processor, such as a general purpose integrated circuit microprocessor, or each sub-processor may have its own processor for executing instructions. Alternatively, some or all of the sub-processors may be implemented in an ASIC. RAM may be embodied in one or more memory chips.

Memory 404 may include both volatile and persistent memory for the storage of: operational instructions for execution by microprocessor 402, data registers, application storage and the like. The computer instructions/applications that are stored in memory 404 are executed by processor 402. The I/O subsystem 406 may comprise various end user interfaces such as a display, a keyboard, and a mouse. The I/O subsystem 406 comprises a data network interface 490. The network interface 490 allows software and data to be transferred between the ECM 400 and external hosts or devices. Examples of network interface 490 can include one or a plurality of: Ethernet network interface card, wireless network interface card, network interface adapter via USB, wireless cellular modem, and the like. Data transferred via network interface 490 are in the form of signals which may be, for example, electronic, electromagnetic, radio frequency, optical, or other signals capable of being transmitted or received by network interface 490.

For purposes of this disclosure, the user's device 195 may also represent any type of computer, information processing system, or other programmable electronic device, including a client computer, a server computer, a portable computer such as a laptop device, an embedded controller, a software or microcode embedded in devices or appliances such as a mobile telephone such as an Apple iPhone, Television sets, Air Conditioning thermostats, home alarm systems, application-specific integrated circuit (ASIC), special-purpose microcontrollers, and the like that has been specially programmed to perform the functions of interfacing and communicating with the ECM 400 as disclosed herein.

Further, in view of many embodiments to which the principles of the invention may be applied, it should be understood that the illustrated embodiments are exemplary embodiments and should not limit the present disclosure.

Therefore, while there has been described what is presently considered to be the preferred embodiment, it will be understood by those skilled in the art that other modifications can be made within the spirit of the disclosure. The above description(s) of embodiment(s) is not intended to be exhaustive or limiting in scope. The embodiment(s), as described, were chosen in order to explain the principles of the invention, show its practical application, and enable those with ordinary skill in the art to understand how to make and use the invention. It should be understood that the invention is not limited to the embodiment(s) described above, but rather should be interpreted within the full meaning and scope of the disclosure.

What is claimed is:

1. A garage door system comprising:

a garage door having at least a door panel, the door panel comprising:

a solid portion;

a hollow portion; and an opening through the door panel; and a motorized panel apparatus disposed substantially within the hollow portion of the door panel, the motorized panel apparatus comprising:

a retracting mechanism comprising:

an upper rack fixedly attached to the door panel and disposed substantially within the hollow portion of the door panel and above the opening;

a lower rack fixedly attached to the door panel parallel to and in spaced relation to the upper rack and disposed below the opening substantially within the hollow portion of the door panel;

an upper pinion operatively in communication with the upper rack;

a lower pinion operatively in communication with the lower rack;

a retracting shaft axially connecting the upper pinion and the lower pinion such that a rotation of the retracting shaft causes a corresponding rotation of the upper pinion and the lower pinion; and a retracting motor with a retracting motor output shaft operatively in communication with the retracting shaft such that a rotation of the retracting motor output shaft causes the rotation of the retracting shaft; and a panel mount rotatably disposed on the retracting shaft and fixed between the upper pinion and the lower pinion such that the retracting shaft is free to rotate with respect to the panel mount;

a rotating mechanism comprising;

a rotation shaft rotably attached to the panel mount and disposed substantially perpendicular to the retracting shaft such that a translation of the retracting shaft causes a corresponding translation of the rotation shaft; and a rotation motor with a rotation motor output shaft operatively in communication with the rotation shaft such that a rotation of the rotation motor output shaft causes a rotation of the rotation shaft; and a panel connected to the rotation shaft such that the rotation of the rotation shaft causes a corresponding rotation of the panel;

wherein the motorized panel apparatus is operable to translate the panel between a position substantially within the hollow portion of the door panel and a position substantially within the opening of the door panel, and further operable to rotate the panel between a position substantially parallel to a major planar face of the door panel and a position substantially perpendicular to the major planar face of the door panel.

2. The garage door system of claim 1 further comprising an electronics and control module fixedly attached to the door panel and electrically connected to each of the retracting motor and the rotation motor.

3. The garage door system of claim 2 wherein the electronics and control module comprises a carbon monoxide sensor and a logic module, the electronics and control module is configured to activate the rotation motor to rotate the panel to the position substantially perpendicular to the major planar face of the door panel when the carbon monoxide sensor detects an amount of carbon monoxide larger than a preset first amount.

4. The garage door system of claim 3 wherein, when the carbon monoxide sensor detects a preset second amount of carbon monoxide after having detected the preset first amount of carbon monoxide, the electronics and control module activates the rotation motor to rotate the panel to the position substantially parallel to the major planar face of the door panel, wherein the second amount of carbon monoxide being less than the first amount of carbon monoxide.

5. The garage door system of claim 2 wherein the electronics and control module further comprises a communications module and is a node in a data network.

6. The garage door system of claim 5 wherein the electronics and control module is configured to receive at least one instruction from a device on the data network.

7. The garage door system of claim 5 wherein the electronics and control module is configured to send at least one instruction to a device on the data network.

* * * * *